US006276410B1

(12) United States Patent
Esmeralda

(10) Patent No.: US 6,276,410 B1
(45) Date of Patent: Aug. 21, 2001

(54) OIL FUNNEL ASSEMBLY

(76) Inventor: Stephen G. Esmeralda, 95-1037 Lalai St., Mililani Town, HI (US) 96789

( * ) Notice: Subject to any disclaimer, the term of this patent is extended or adjusted under 35 U.S.C. 154(b) by 0 days.

(21) Appl. No.: 09/666,918

(22) Filed: Sep. 21, 2000

(51) Int. Cl.[7] ..... B65B 39/00; B67C 11/04

(52) U.S. Cl. ..... 141/332; 141/98; 141/100; 141/105; 141/106; 141/331; 141/332; 141/334; 141/340; 184/1.5

(58) Field of Search ..... 141/98, 100, 105, 141/106, 331–345; 184/1.5, 106

(56) References Cited

U.S. PATENT DOCUMENTS

D. 329,655 9/1992 Bonnell .
D. 391,274 2/1998 Gasior .
2,071,944 * 2/1937 Hoffman ..... 141/332
3,643,704 2/1972 Carr .
4,832,095 5/1989 Bonnell .
5,269,426 12/1993 Burleigh et al. .
5,477,897 * 12/1995 Scofield ..... 141/105
5,967,201 * 10/1999 Gasior ..... 141/98
5,967,203 10/1999 Culver, III .

* cited by examiner

*Primary Examiner*—Timothy L. Maust

(57) ABSTRACT

An oil funnel assembly for providing a user with a more efficient and quicker way to change oil. The oil funnel assembly includes a funnel that includes an upper portion and a lower portion. The lower portion includes a distribution opening that is designed for inserting into an oil receiving port of an engine. A plurality of dividers are coupled to the upper portion of the funnel. The dividers are positioned to form a grid that includes a plurality of spaces. Each of the spaces is designed for receiving and holding an inverted oil container such that oil in the inverted oil container drains into the funnel and out of the distribution opening.

16 Claims, 3 Drawing Sheets

OIL FUNNEL ASSEMBLY

BACKGROUND OF THE INVENTION

1. Field of the Invention

The present invention relates to oil funnels and more particularly pertains to a new oil funnel assembly for providing a user with a more efficient and quicker way to change oil.

2. Description of the Prior Art

The use of oil funnels is known in the prior art. More specifically, oil funnels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,832,095; U.S. Pat. No. 3,643,704; U.S. Pat. No. 5,967,203; U.S. Pat. No. Des. 329,655; U.S. Pat. No. 5,269,426; U.S. Pat. No. Des. 391,274.

While these devices fulfill their respective, particular objectives and requirements, the aforementioned patents do not disclose a new oil funnel assembly. The inventive device includes a funnel that includes an upper portion and a lower portion. The lower portion includes a distribution opening that is designed for inserting into an oil receiving port of an engine. A plurality of dividers are coupled to the upper portion of the funnel. The dividers are positioned to form a grid that includes a plurality of spaces. Each of the spaces is designed for receiving and holding an inverted oil container such that oil in the inverted oil container drains into the funnel and out of the distribution opening.

In these respects, the oil funnel assembly according to the present invention substantially departs from the conventional concepts and designs of the prior art, and in so doing provides an apparatus primarily developed for the purpose of providing a user with a more efficient and quicker way to change oil.

SUMMARY OF THE INVENTION

In view of the foregoing disadvantages inherent in the known types of oil funnels now present in the prior art, the present invention provides a new oil funnel assembly construction wherein the same can be utilized for providing a user with a more efficient and quicker way to change oil.

The general purpose of the present invention, which will be described subsequently in greater detail, is to provide a new oil funnel assembly apparatus and method which has many of the advantages of the oil funnels mentioned heretofore and many novel features that result in a new oil funnel assembly which is not anticipated, rendered obvious, suggested, or even implied by any of the prior art oil funnels, either alone or in any combination thereof.

To attain this, the present invention generally comprises a funnel that includes an upper portion and a lower portion. The lower portion includes a distribution opening that is designed for inserting into an oil receiving port of an engine. A plurality of dividers are coupled to the upper portion of the funnel. The dividers are positioned to form a grid that includes a plurality of spaces. Each of the spaces is designed for receiving and holding an inverted oil container such that oil in the inverted oil container drains into the funnel and out of the distribution opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oil funnel assembly apparatus and method which has many of the advantages of the oil funnels mentioned heretofore and many novel features that result in a new oil funnel assembly which is not anticipated, rendered obvious, suggested, or even implied by any of the prior art oil funnels, either alone or in any combination thereof.

It is another object of the present invention to provide a new oil funnel assembly which may be easily and efficiently manufactured and marketed.

It is a further object of the present invention to provide a new oil funnel assembly which is of a durable and reliable construction.

An even further object of the present invention is to provide a new oil funnel assembly which is susceptible of a low cost of manufacture with regard to both materials and labor, and which accordingly is then susceptible of low prices of sale to the consuming public, thereby making such oil funnel assembly economically available to the buying public.

Still yet another object of the present invention is to provide a new oil funnel assembly which provides in the apparatuses and methods of the prior art some of the advantages thereof, while simultaneously overcoming some of the disadvantages normally associated therewith.

Still another object of the present invention is to provide a new oil funnel assembly for providing a user with a more efficient and quicker way to change oil.

Yet another object of the present invention is to provide a new oil funnel assembly which includes a funnel that includes an upper portion and a lower portion. The lower portion includes a distribution opening that is designed for inserting into an oil receiving port of an engine. A plurality of dividers are coupled to the upper portion of the funnel. The dividers are positioned to form a grid that includes a plurality of spaces. Each of the spaces is designed for receiving and holding an inverted oil container such that oil in the inverted oil container drains into the funnel and out of the distribution opening.

Still yet another object of the present invention is to provide a new oil funnel assembly that allows a user to cut the time it takes to change oil in half.

Even still another object of the present invention is to provide a new oil funnel assembly that reduces the chance of spillage and also reducing the clutter of having oil containers on the floor of the workspace and engine compartment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
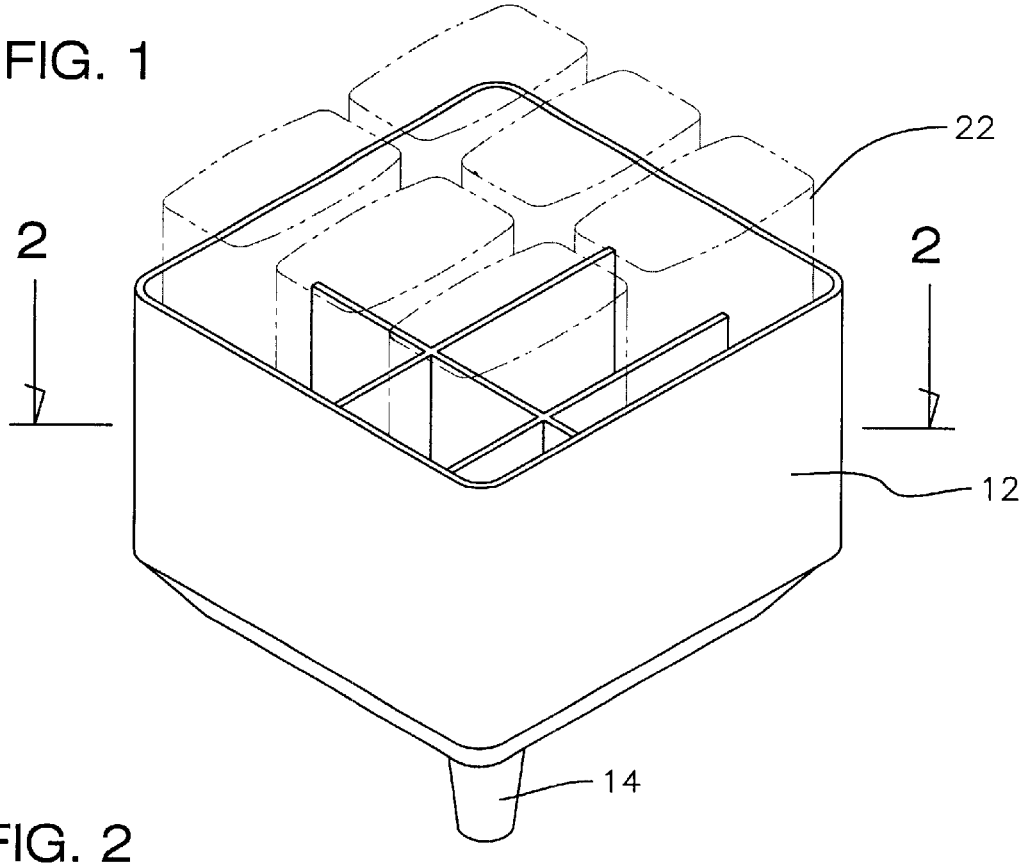
FIG. 1 is a perspective view of a new oil funnel assembly according to the present invention.
Figure 2:
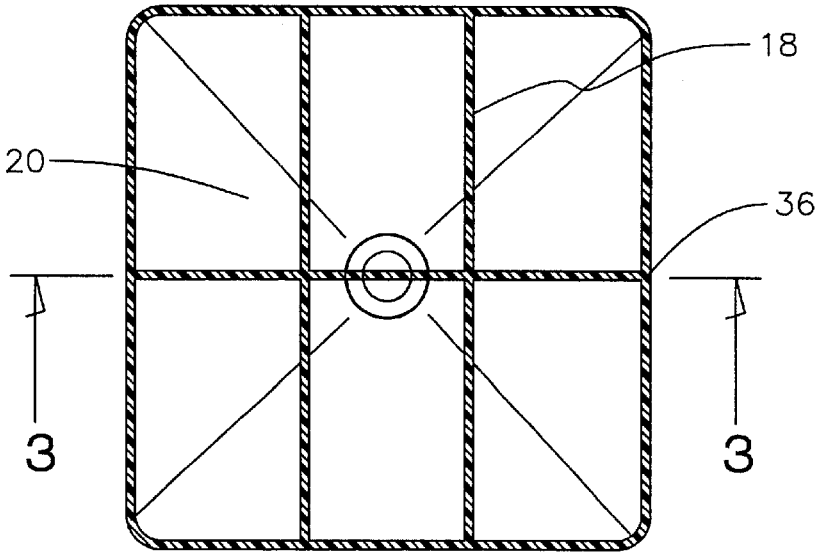
FIG. 2 is a top view of the present invention.
Figure 3:
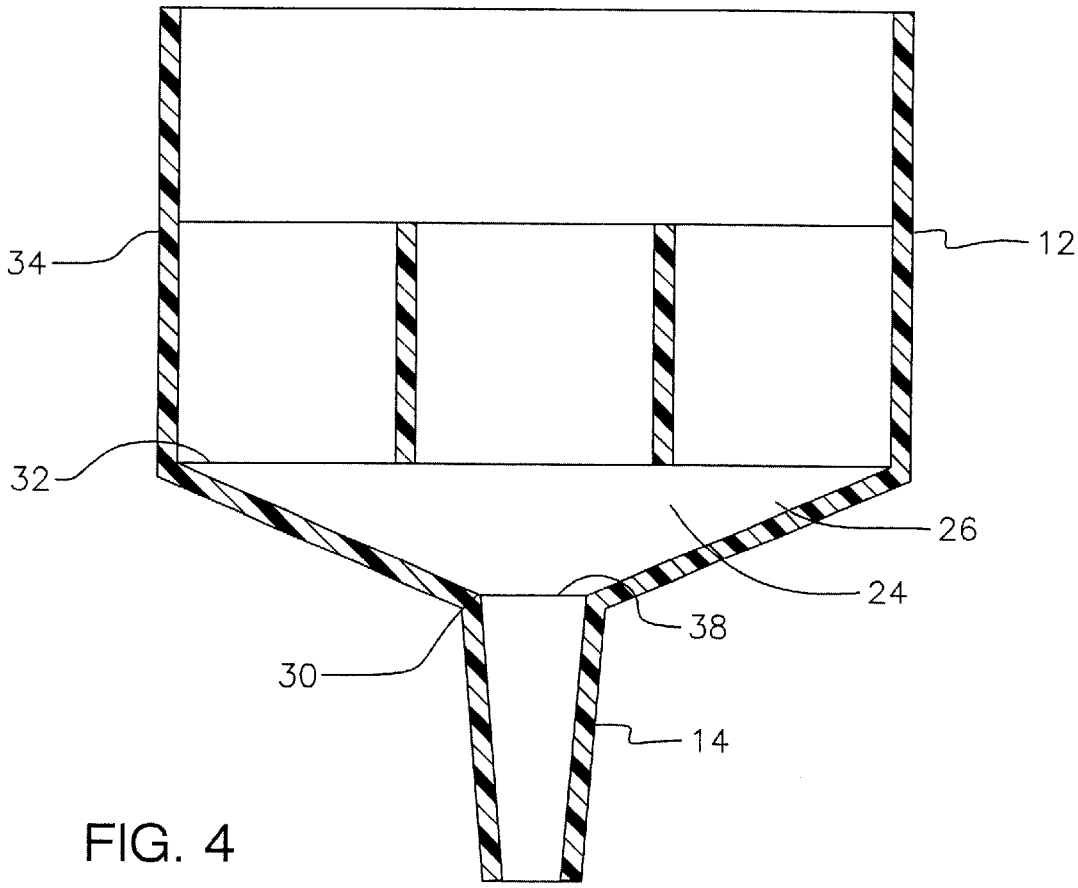
FIG. 3 is a side view of the present invention.
Figure 4:
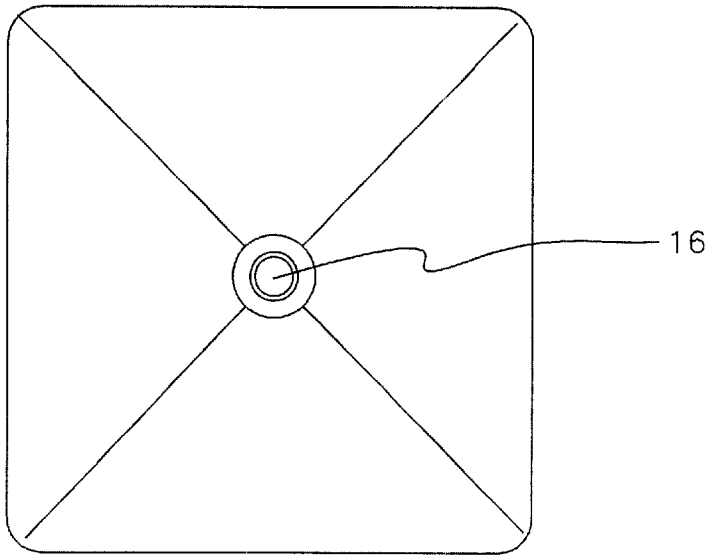
FIG. 4 is a bottom view of the present invention.
Figure 5:
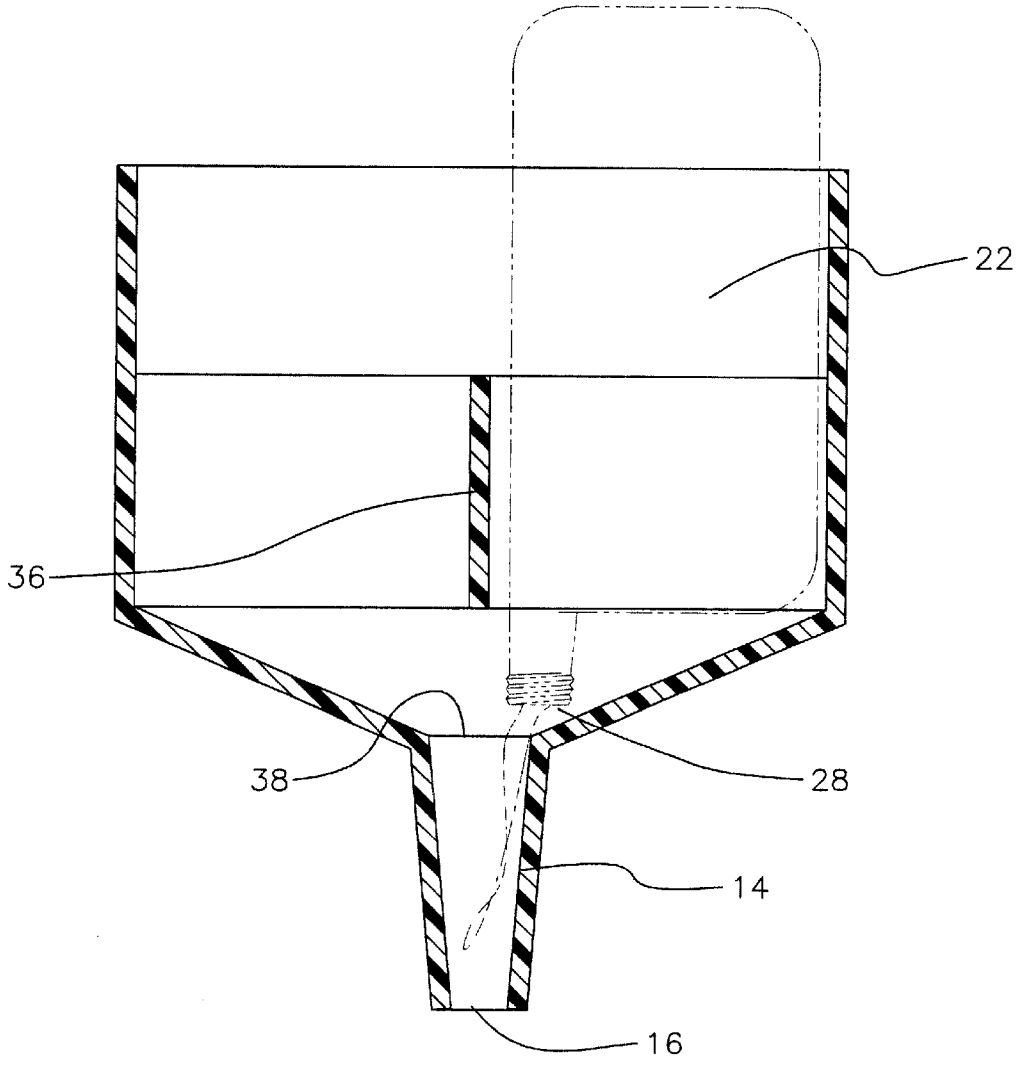
FIG. 5 is a cutaway view of the present invention.

With reference now to the drawings, and in particular to FIGS. 1 through 5 thereof, a new oil funnel assembly embodying the principles and concepts of the present invention and generally designated by the reference numeral 10 will be described.

As best illustrated in FIGS. 1 through 5, the oil funnel assembly 10 generally includes a generally square upper portion 12 and a generally tubular lower portion 14. The lower portion 14 includes a distribution opening 16 that is designed for inserting into an oil receiving port of an engine.

A plurality of dividers 18 coupled to the upper portion 12 of the funnel are positioned to form a grid forming six spaces, each of the spaces 20 is designed for receiving and holding an associated inverted oil container 22 such that oil in the inverted oil container 22 drains into the funnel and out of the distribution opening 16 whereby the funnel is designed for simultaneously holding and draining six oil containers 22.

The funnel includes a shallow intermediate portion 24 that extends between the lower portion 14 and the upper portion 12 such that an interior face 26 of the intermediate portion 24 is positioned for supporting the oil container 22 when the oil container 22 is inverted and inserted into a selectable one of the spaces 20 whereby the oil container 22 is held in the inverted position in the selectable one of the spaces 20.

The interior face 26 of the intermediate portion 24 is angled such that the interior face 26 is designed for abutting a portion of a rim 28 of an opening of the oil container 22 for preventing blocking of the opening in the oil container 22 when the oil container 22 is inverted and inserted into the selectable one of the plurality of spaces 20 such that the interior face 26 supports the oil container 22.

The lower portion 14 is elongated and tapers from an upper end 30 of the lower portion 14 to a lower end 32 of the upper portion 12 for facilitating insertion of the lower end 32 of the upper portion 12 into the oil receiving port of the engine.

The upper portion 12 includes a substantially vertical outer perimeter wall 34 such that the outer perimeter wall 34 is designed for providing lateral support to the oil container 22 when the oil container 22 is inverted and inserted into a selectable one of the plurality of spaces 20. The plurality of dividers 18 includes a central divider 36 that is positioned above an upper opening 38 in the lower portion 14 whereby the central divider 36 is designed for holding the oil container 22 in an offset position relative to the upper opening 38 in the lower portion 14 for preventing the oil container 22 from blocking the upper opening 38 in the lower portion 14.

In use, a user will place the funnel in the valve cover opening and place the containers of oil right side up in the funnel; when the user is ready to disperse the oil the containers can be turned over one at a time allowing you to quickly disperse the oil.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An oil funnel assembly comprising:

a funnel having an upper portion and a lower portion, said lower portion having a distribution opening, said lower portion being adapted for inserting into an oil receiving port of an engine; and a plurality of dividers coupled to said upper portion of said funnel, said dividers being positioned to form a grid having a plurality of spaces, each of said spaces being defined by at least two opposed wall surfaces, each of said at least two wall surfaces of each said space being oriented substantially parallel to each other for receiving and holding an inverted oil container such that oil in the inverted oil container drains into said funnel and out of said distribution opening.

2. The oil funnel assembly of claim 1, further comprising:

said funnel having a shallow intermediate portion extending between said lower portion and said upper portion such that an interior face of said intermediate portion is positioned for supporting the oil container when the oil container is inverted and inserted into a selectable one of said plurality of spaces whereby the oil container is held in the inverted position in said selectable one of said plurality of spaces.

3. The oil funnel assembly of claim 2, further comprising:

said interior face of said intermediate portion being angled for preventing blocking of an opening in the oil container when the oil container is inverted and inserted into said selectable one of said plurality of spaces such that said interior face supports the oil container.

4. The oil funnel assembly of claim 1, further comprising:

said lower portion being elongated and tapering from an upper end of said lower portion to a lower end of said upper portion for facilitating insertion of said lower end of said upper portion into the oil receiving port of the engine.

5. The oil funnel assembly of claim 1, further comprising:

said upper portion having a substantially vertical perimeter wall such that said perimeter wall is adapted for providing lateral support to the oil container when the oil container is inverted and inserted into a selectable one of said plurality of spaces.

6. The oil funnel assembly of claim 1, further comprising:

said plurality of dividers including a central divider, said central divider being positioned above an upper opening in said lower portion whereby said central divider is adapted for holding the oil container in an offset position relative to said upper opening in said lower portion for preventing said oil container from blocking said upper opening in said lower portion.

7. The oil funnel assembly of claim 1, wherein said upper, interior, and lower portions each have an interior in fluid communication with each other, said upper portion of said funnel having an upper perimeter wall, said intermediate portion of said funnel having an intermediate perimeter wall, said lower portion of said funnel having a lower perimeter wall, a central axis extending through the interiors of said upper, intermediate, and lower portions of said funnel.

8. The oil funnel assembly of claim 7, wherein a cross section of said upper perimeter wall of said funnel in a plane oriented substantially perpendicular to said central axis is substantially rectangular.

9. The oil funnel assembly of claim 7, wherein said intermediate perimeter wall of said funnel has a substantially frusta-pyramidal shape.

10. The oil funnel assembly of claim 1, wherein the plurality of spaces comprises six spaces.

11. The oil funnel assembly of claim 1, wherein at least a first one of said plurality of dividers is oriented substantially perpendicular to at least a second one of said plurality of dividers.

12. The oil funnel assembly of claim 1, wherein at least two of said wall surfaces defining each of said plurality of spaces are oriented substantially perpendicular to each other.

13. The oil funnel assembly of claim 12, wherein a first pair of said wall surfaces defining each of said spaces are oriented substantially parallel to each other and a second pair of said wall surfaces defining each of said spaces are oriented substantially parallel to each other.

14. The oil funnel assembly of claim 1 wherein the plurality of dividers comprises a pair of substantially parallel walls and a wall oriented substantially perpendicular to said pair of substantially parallel walls.

15. The oil funnel assembly of claim 1 wherein the plurality of dividers each have a substantially uniform height, and wherein the upper perimeter wall of the funnel has a height, and wherein the height of the upper perimeter wall is approximately twice the height of the plurality of dividers.

16. An oil funnel assembly comprising:

a funnel having a generally square upper portion and a generally tubular lower portion, said lower portion having a distribution opening, said lower portion being adapted for inserting into an oil receiving port of an engine;

a plurality of dividers coupled to said upper portion of said funnel, said dividers being positioned to form a grid forming six spaces, each of said spaces being adapted for receiving and holding an associated inverted oil container such that oil in the inverted oil container drains into said funnel and out of said distribution opening whereby said funnel is adapted for simultaneously holding and draining six oil containers;

said funnel having a shallow intermediate portion extending between said lower portion and said upper portion such that an interior face of said intermediate portion is positioned for supporting the oil container when the oil container is inverted and inserted into a selectable one of said spaces whereby the oil container is held in the inverted position in said selectable one of said spaces;

said interior face of said intermediate portion being angled such that said interior face is adapted for abutting a portion of a rim of an opening of the oil container for preventing blocking of the opening in the oil container when the oil container is inverted and inserted into said selectable one of said plurality of spaces such that said interior face supports the oil container;

said lower portion being elongated and tapering from an upper end of said lower portion to a lower end of said upper portion for facilitating insertion of said lower end of said upper portion into the oil receiving port of the engine;

said upper portion having a substantially vertical outer perimeter wall such that said outer perimeter wall is adapted for providing lateral support to the oil container when the oil container is inverted and inserted into a selectable one of said plurality of spaces; and said plurality of dividers including a central divider, said central divider being positioned above an upper opening in said lower portion whereby said central divider is adapted for holding the oil container in an offset position relative to said upper opening in said lower portion for preventing said oil container from blocking said upper opening in said lower portion.

* * * * *